US007426981B2

(12) United States Patent
Bacellar et al.

(10) Patent No.: US 7,426,981 B2
(45) Date of Patent: Sep. 23, 2008

(54) ELEVATOR WIRELESS COMMUNICATION INFRASTRUCTURE USING PICONET MODULES

(75) Inventors: Luiz Bacellar, Glastonbury, CT (US); Deborah C. Haas, Coventry, CT (US); Adriana Bacellar, Glastonbury, CT (US); Bruce Zepke, Glastonbury, CT (US); Christian M. Netter, Vernon, CT (US); Paul A. Stucky, Vernon, CT (US); Alberto Vecchiotti, Middletown, CT (US); William A. Veronesi, Hartford, CT (US); Joseph Zacchio, Wethersfield, CT (US)

(73) Assignee: Otis Elevator Company, Farmington, CT (US)

( * ) Notice: Subject to any disclaimer, the term of this patent is extended or adjusted under 35 U.S.C. 154(b) by 314 days.

(21) Appl. No.: 10/527,974

(22) PCT Filed: Oct. 15, 2002

(86) PCT No.: PCT/US02/32848

§ 371 (c)(1),
(2), (4) Date: Aug. 11, 2005

(87) PCT Pub. No.: WO2004/035449

PCT Pub. Date: Apr. 29, 2004

(65) Prior Publication Data

US 2006/0108181 A1 May 25, 2006

(51) Int. Cl.
*B66B 1/28* (2006.01)

(52) U.S. Cl. ..... 187/247; 187/391

(58) Field of Classification Search ..... 187/247, 187/287, 289, 391, 393, 316, 413, 414, 900; 340/505, 507, 518, 521, 522
See application file for complete search history.

(56) References Cited

U.S. PATENT DOCUMENTS

| | | | | |
|---|---|---|---|---|
| 3,203,506 | A * | 8/1965 | Cummins | 187/391 |
| 4,462,080 | A | 7/1984 | Johnstone et al. | |
| 5,708,416 | A * | 1/1998 | Zaharia et al. | 340/531 |
| 6,070,139 | A | 5/2000 | Miyazawa et al. | |
| 6,109,396 | A | 8/2000 | Sirag et al. | |

(Continued)

FOREIGN PATENT DOCUMENTS

EP 0 971 330 A1 12/2000

*Primary Examiner*—Jonathan Salata

(57) ABSTRACT

An elevator system has on each floor hall call buttons that are inter-connected with piconet modules (15), such as modules conforming to BLUETOOTH™ specifications; similar piconet modules (16) may be associated with hall fixtures such as lanterns and gongs; similar piconet modules (50) may be associated with hoistway doors, on each floor, so as to form a wireless communication system with a similar piconet module (19) at the controller (18); and a piconet module (40) may be associated with the car operating panel. A module (43) may be interconnected with the car door lock switch; a module (44) may be interconnected with a safety switch; modules (48) and (49) may be interconnected with lower and upper limit switches; and a module (49) may be interconnected with an overspeed detector, so as to form a safety chain. A prospective passenger (53) may carry a portable device with a piconet module (54) to request elevator service and receive acknowledgment, and maintenance personnel (58) may use a personal ditigal assistant having a piconet module (58) therein to acquire current and historical information about the elevator and to issue executable commands to the elevator system.

11 Claims, 2 Drawing Sheets

U.S. PATENT DOCUMENTS

| | | | | |
|---|---|---|---|---|
| 6,173,814 | B1 * | 1/2001 | Herkel et al. | 187/288 |
| 6,202,799 | B1 | 3/2001 | Drop | |
| 6,425,460 | B2 * | 7/2002 | Schuster | 187/247 |
| 6,467,585 | B1 * | 10/2002 | Gozzo et al. | 187/391 |
| 6,481,531 | B1 * | 11/2002 | Nagura et al. | 187/247 |
| 6,601,679 | B2 * | 8/2003 | Crenella et al. | 187/395 |
| 6,868,945 | B2 * | 3/2005 | Schuster et al. | 187/380 |
| 2006/0207837 | A1 * | 9/2006 | Zepke et al. | 187/392 |

* cited by examiner

ELEVATOR WIRELESS COMMUNICATION INFRASTRUCTURE USING PICONET MODULES

TECHNICAL FIELD

This invention relates to an elevator system in which communication between the controller and every hardware element of the elevator system, including hall fixtures, safety devices and the car operating panel, is effected by piconet modules having transceivers operating in the 2.4 GHz band which automatically create networks of intermodule links with other compatible modules in the system.

BACKGROUND ART

Wireless communications within elevator systems are known. For the most part, such systems are concerned with entering calls for elevator service without requiring the use of hands, and at some distance from the elevator entrance. Examples are U.S. Pat. Nos. 4,979,594; 4,709,788; and 5,984,051. In these systems, RF devices interact with specific transceivers interconnected with wires to hardware devices. Custom protocols and addressing schemes are required. A failure of any particular transceiver interrupts the link which such transceiver is established to maintain. Alteration of devices having different addresses requires reprogramming the system, sometimes extensively, to accommodate new addresses of new or substitute devices. Other elevator systems utilizing wireless communications, which include handling operating signals, are disclosed in U.S. Pat. Nos. 4,979,593; and 5,601,156. U.S. Pat. No. 5,817,994 discloses a wireless maintenance tool, which is limited to causing the elevator to travel upwardly or downwardly, and a wireless receiver that is connectable by personnel to a car operating panel when it is desired to use it. These devices also have problems associated with wireless systems known heretofore.

In U.S. patent application Ser. No. 09/899,400, filed Jul. 5, 2001, a wireless safety chain is disclosed. In this system, the infrastructure is rigid and it has the problems referred to hereinbefore. Any system comprised of passive radio frequency identification devices requires being within close proximity of transceivers which not only communicate with them, but also supply operational power for them.

DISCLOSURE OF INVENTION

Objects of the invention include provision of an elevator communication system having wireless communications: which, because of the characteristics of the modules which formulate the elevator communication system, is capable of automatically providing communication between any two or more functional parts of the elevator system associated with one of said modules as the communication system is established in the first instance, easily supports any requirement for system redefinition, introduction or changing of addresses, or the like, as alterations in the communication system itself are made; avoids the need for changes in the hardware structures with which various modules of the communication system interrelate as other hardware changes are made; which is not dependent on a particular rigid relationship between one module and the next to establish communication from any one particular point to any other particular point, but, instead, is able to establish communication between such two points without reliance on any individual intermediate module of the system; which is a non-failing, self-healing system automatically establishing, with no human intervention, alternative paths for completing communication between any particular points of the system; and in which any compatible elements may be exchanged, introduced, or utilized without redefining any system parameters or protocols, including addresses, priorities, synchronization, and control relationships.

This invention is predicated in part on the realization that an elevator communication system should not be dependent upon any single intermediate wire or any single intermediate transceiver to effect the necessary communications for all elevator functions, and in part on the recognition that a ubiquitous hoistway wireless communication system will serve to communicate requests for service and responses thereto, operational data and controls, and safety information, and permit maintenance inquiries into elevator history, conditions and parameter status information, as well as causing commands of service personnel to exercise control over the elevator.

According to the present invention, the term "defined piconet module" as used herein, sometimes referred to herein as "piconet module" for short, is a module including a transceiver and having the following characteristics:

- automatically establishes a link with any similar module within their mutual transmission range;
- identifies itself (address) to other modules;
- will receive and retransmit messages to other modules;
- messages can be sent synchronously or asynchronously;
- will create ad-hoc networks with one or more compatible modules;
- low power, short range (e.g., either ten meters or 100 meters, depending on a selected version of the modules) radio transmissions in the 2.4 GHz and/or 5.8 GHz frequency band;
- there is no designated, dedicated master;
- any module is capable of initiating a transmission and assuming the role of "master", and is also capable of responding to a transmission and assuming the role of "slave"; and also capable of negotiating the master/slave relationship;
- links between it and other modules are closed down as the distance between them exceeds their mutual communication range;
- one or more different low-power modes of operation, such as "sleep" and "standby", to save substantial power;
- point-to-point and point-to-multipoint connections; and
- spread spectrum.

According to the invention, the functional parts of an elevator system are associated, individually or in small groups, with corresponding piconet modules, as defined hereinbefore, which form piconets with other piconet modules such that communication between any two functional parts of an elevator system may be made automatically, seamlessly and with an extremely high degree of system reliability which exceeds that available in the prior art. "Piconets" are ad-hoc networks of two or more automatically linked piconet modules. According to the invention, piconet modules are associated with the elevator controller and individual hall call buttons or pairs of hall call buttons. Piconet modules may also be associated with hall fixtures such as hall lanterns and gongs (where used), with safety switches and other safety devices, and with the car operating panel, such that all communications are initiated by, passed along by, and received by piconet modules as defined herein. According to the invention, piconet modules in passengers' remote control devices and in portable maintenance controllers communicate through the piconet modules of the elevator system.

Piconet modules may be selected from available products conforming to BLUETOOTH™ specifications, as set forth at www.BLUETOOTH.ORG, or may be custom designed to have the foregoing characteristics, with or without conforming fully with BLUETOOTH specifications. As is known, BLUETOOTH compatible devices comprise a radio built into a small integrated circuit, which operates in the globally available 2.4 GHz frequency band, thereby ensuring communication compatibility throughout the world.

Optional features of the modules useful, but not required for implementing the invention include:

- adaptive transmitter power (range) for power saving and to ensure not overwhelming (swamping) weaker transmitters that are close by or adaptive power may be accomplished with software, such as in the controller;
- ability to communicate synchronously with reserved bandwidth (to enable a voice communication option); and
- security by virtue of encryption and/or authentication to avoid unauthorized interference with elevator operation.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
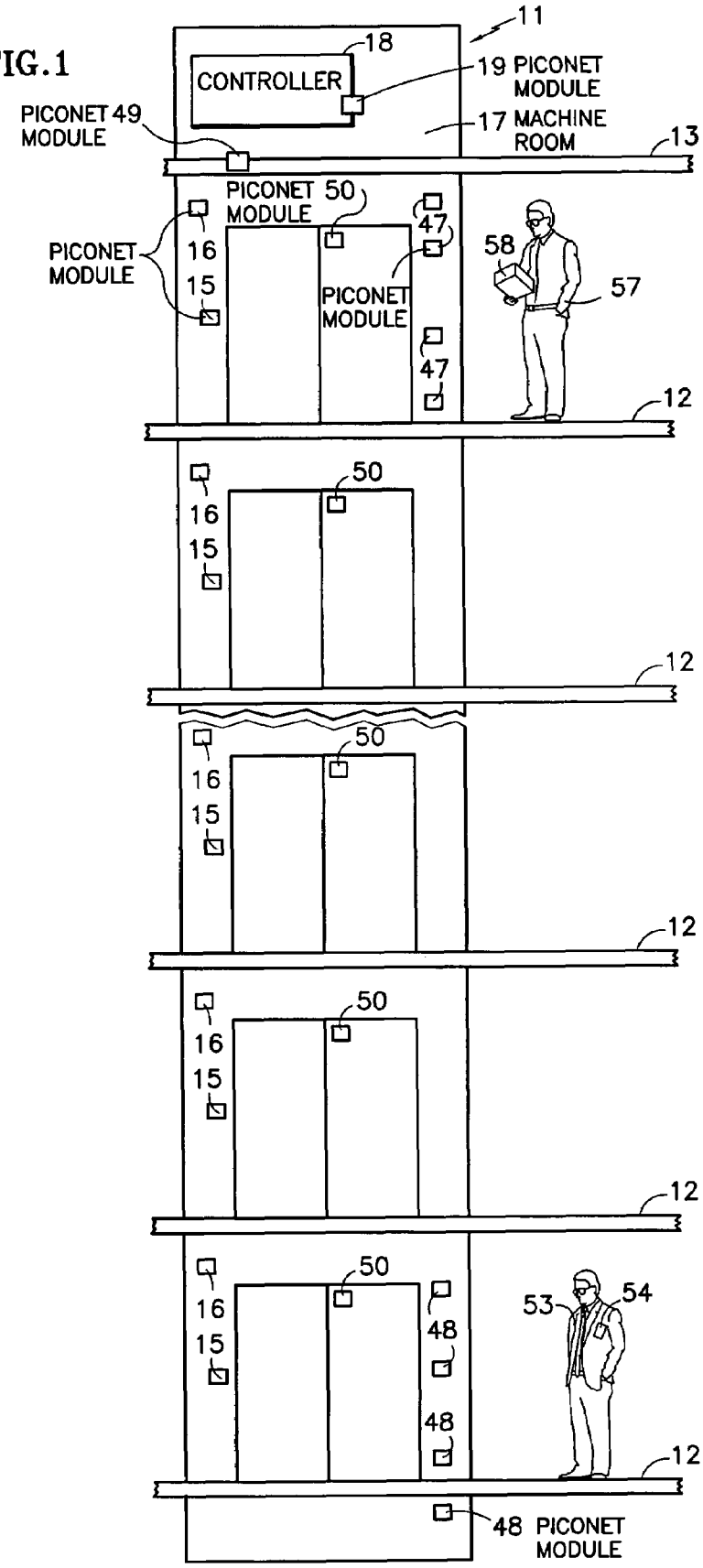
FIG. 1 is a simplified, stylized, front elevation schematic of an elevator hoistway and machine room incorporating the invention.

Referring to FIG. 1, a hoistway 11 of an elevator system includes a plurality of landings 12 and a machine floor 13. At each landing 12, there is a traditional up hall call button or a traditional down hall call button (not shown) or both, each single hall call button and each pair of hall call buttons being associated with a related defined piconet module 15. The hall fixtures, such as lanterns and gongs, on each floor 12, where such are utilized, can be controlled by communications through the module 15 on that floor, with wiring there between. On the other hand, either or both of the fixtures may have their own or share a similar piconet module 16, if desired in any utilization of the present invention. In the machine room 17 (or at some suitable location within the hoistway 11) a controller 18 is associated with a defined piconet module 19. An important aspect of the present invention is that each of the modules 15 can participate in a piconet of one or several additional modules 15, 16, 19, and may form ad hoc scatternets with other piconets including the modules 15, 16, 19. In this way, other similar, compatible defined piconet modules within range of any of the modules 15, 16, around the hoistway 11, at any of its floors or landings 12, 13 may be in communication with each other floor or landing of the hoistway as well as with the controller 18.

Figure 2:
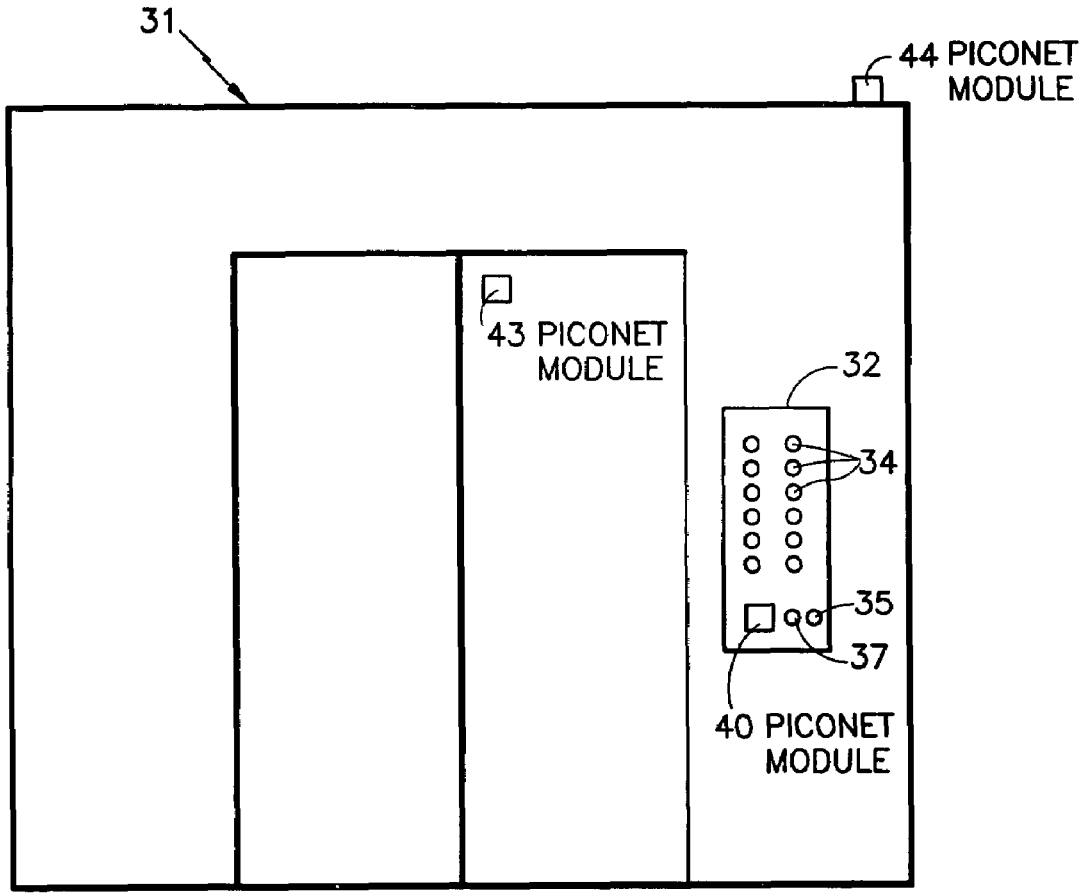
FIG. 2 is a simplified, front elevation schematic of an elevator car incorporating the present invention.

An important feature of the present invention is illustrated in FIG. 2. Therein, an elevator car 31 has a car operating panel 32 with a plurality of conventional car call buttons 34, a door open button 35 and an emergency stop switch 37. The car operating panel communicates through a defined piconet module 40. In some buildings, depending on the version of the defined piconet modules, the transceiver 40 may well be out of range of the transceiver 19 at the controller 18 (FIG. 1) when the car 31 is in a lower portion of the hoistway 11. It therefore takes advantage of the wireless, instant connection between various conforming modules that are within the range of each other. When the elevator car 31 is near the low end of the hoistway, the module 40 will establish a link between it and ones of the modules 16 that are at the low end of the hoistway, which will cause the communications to be transferred upwardly through the piconet via ones of the modules 15, 16 on the upper floors, to the module 19 at the controller 18. Without the establishment of a piconet by means of the modules 15, 16, the transceiver of the module 40 would have to establish communications through a rigid protocol with conventional other transceivers.

In addition to handling communications from the car operating panel 32, the module 40 can also receive and execute door open and door close commands, and other conventional commands to be executed within the elevator car 31.

Another advantage of the piconet established by the modules on each of the floors of the building is the ability to have a seamless elevator safety chain. In the elevator 31, there is a module 43 associated with the elevator door lock switch which must indicate that the door is locked, or the safety chain is thereby broken and the elevator is prevented from moving. Similarly, a module 44 associated with an inspection switch on the canopy of the elevator indicates when personnel are in an unsafe position with respect to the elevator, so it should be prevented from moving. The modules 43 and 44 will communicate with the module 19 at the controller 18 by means of the piconet established by the modules 15, 16 on the various floors. In a similar fashion, other elements of the safety chain, illustrated in FIG. 1, may include upper and lower limit switches (not shown), each of which may be associated with a corresponding module 47, 48. In many installations, the modules 48 will be out of range of the module 19, but will be automatically in communication therewith by virtue of the piconets established by the modules 15, 16 on the various floors. The safety chain will include an overspeed detector (not shown) with an associated module 49, and will include hoistway door locks (not shown) each of which has a module 50 associated therewith. The modules 50 can form piconets with the modules 15 or 16 and with each other: that is, the hoistway communication system may include links with either modules 15, modules 16, or modules 50, or all of these.

In accordance with an aspect of the invention, a prospective passenger 53 bearing a remote control device which contains a defined piconet module 54 will have an elevator service request automatically entered for her as a consequence of the module 54 coming within range of one of the modules 15, 16, 50. As before described, the module 54 will automatically synchronize the remote control device with the elevator system and the building system database. Communications will include identity of the person, her normal floor destination, her current location, e.g., the first floor, and if involved, her access security status. Whenever the passenger 53 brings the remote control device within module range, the module 54 will automatically create an ad-hoc network with at least one of the modules 15, 16, 48 or 50, which in turn will add to the network through other modules 15, 16, 50 so as to be in communication with the module 19 at the controller 18. The module 54 will also receive acknowledgments of accepted requests for service.

The invention also permits a maintenance person 57 to use a personal digital assistant (PDA) having a module 58 to create an ad hoc RF network with the hoistway communications infrastructure. Such a PDA may, for instance, comprise any BLUETOOTH-enabled portable computer. When the module 58 within the PDA comes within the range of one of the modules 15, 16, 19, 50, an ad-hoc network is created, putting the service personnel 57 in touch with the controller 18 through the module 19. The service personnel then can make inquires into the status or magnitude of various parameters in the system or the maintenance history of the system, issue executable commands to the system, such as requesting the elevator to approach the corresponding landing, reconfigure the elevator system, particularly with new addresses whenever that is required as a consequence of replacement of any hardware unit, and so forth.

The module 58 within the PDA may initiate a message and become a master. The module 58 may connect point-to-point, such as with a module 15, 16, 50 on the same floor, or make a point-to-multi-point connection, such as from the module 58 to modules 15, 16, 50 on several floors. Depending on the version of the piconet module specification (the range between Bluetooth devices may be 10 meters or 100 meters) piconets may be critical: with a 10 meter version, at any other floor but the highest floor, the module 58 in the PDA would be out of range from the module 19 at the controller 18. Therefore, communication would have to be established from the PDA module 58 to one or more of the modules 15, 16, 50 in floors above the floor where the PDA module 58 is located, ultimately with a module 15, 16, 50 making a connection with the module 19 at the controller 18. With a 100 meter version, such a link, from module to module, could be required for buildings having more than about eight floors. Similarly, when the module 54 establishes a connection with a module 15, 16, 50 on the lowest floor, in order to communicate the service request (hall call destination) to the controller 18, a module 15, 16, 50 on the lowest floor will transmit to those of the modules 15, 16, 50 above it which are within range, which in turn will transmit to modules above them, making a serial net to reach the module 19 at the controller 18 thereby to register the call. Similarly, an acknowledgment of the call from the controller 18 may pass through several modules in order to reach the floor where the call was made.

It can be seen that a floor-to-floor communication system can be composed by having one piconet module on each floor. Therefore, it can be formed by modules which are associated with call buttons, or with lanterns, or with gongs, or, as shown with three modules on each floor, or with one module per floor which is associated with all of the hall devices on that floor; "hall devices" is defined as hall call buttons, lanterns, gongs or hoistway door lock switches, or any combination of them.

The invention claimed is:

1. An elevator system serving a plurality of floors (12) in a building, comprising:

at least one hall device on each of said floors; and a controller (18);

characterized by:

at least one piconet module (15, 16) on each of said floors, at least one said piconet module interconnected with at least one said hall device on the corresponding floor to transmit and receive elevator system operation-related control signals, said defined piconet modules forming piconets with others of said defined piconet modules thereby serving as a floor-to-floor communication system, in which transmissions by any one of said defined piconet modules may be received by others of said defined piconet modules and retransmitted thereby; and a defined piconet module (19) interconnected with said controller, said controller thereby communicating, through said defined piconet module interconnected therewith, with any other of said piconet modules, either directly or through still another one or more of said defined piconet modules, whereby said elevator system operation-related control signals will be communicated between said defined piconet modules interconnected with said at least one hall device on any of said floors and said defined piconet module interconnected with said controller.

2. A system according to claim 1, further comprising:

a personal digital assistant (PDA) having a defined piconet module (58) and containing maintenance-related programs enabling a user thereof to extract information about the elevator system from the elevator system, to issue executable commands to the elevator system, and to reconfigure the elevator system.

3. A system according to claim 1, further comprising:

at least one remote control device having a defined piconet module (54) and configured to communicate requests for elevator service.

4. A system according to claim 3 wherein said remote control device is configured to receive acknowledgments of accepted requests for service.

5. A system according to claim 1 further comprising:

a plurality of safety devices, each interconnected with a related defined piconet module (43, 44, 47, 48-50), said safety devices and related defined piconet modules comprising a safety chain, said related defined piconet modules forming piconets with others of said defined piconet modules and serving with said others of said defined piconet modules as said floor-to-floor communication system.

6. A system according to claim 1 further comprising:

a plurality of hoistway doors, at least one on each floor, a door lock switch associated with each of said doors, a defined piconet module (50) interconnected with each said door lock switch, forming piconets with others of said defined piconet modules and serving with said others of said defined piconet modules as said floor-to-floor communication system.

7. A system according to claim 1 further comprising:

an elevator car (31) having a car operating panel (32) with at least one defined piconet module (40) interconnected therewith, forming piconets with others of said defined piconet modules and serving with said others of said defined piconet modules as said floor-to-floor communication system.

8. A system according to claim 1 further comprising:

an elevator car (31) having at least one car door and a defined piconet module (43) interconnected with at least one said car door, forming piconets with others of said defined piconet modules and serving with said others of said defined piconet modules as said floor-to-floor communication system.

9. A system according to claim 1 wherein:

there is one piconet module (15, 16, 50) on each of said floors, each interconnected with one or more hall call buttons and a hoistway door lock switch on said floor.

10. A system according to claim 9 further comprising:

a gong; and wherein said piconet module (15, 16, 50) is interconnected with said gong.

11. A system according to claim 9 further comprising:

one or more lanterns; and wherein said one or more lanterns are interconnected with said piconet module (15, 16, 50).

* * * * *